United States Patent [19]

Amaudric du Chaffaut

[11] Patent Number: 4,989,679

[45] Date of Patent: Feb. 5, 1991

[54] CENTERING DEVICE THAT CAN BE ENGAGED OR DISENGAGED, SPECIFICALLY FOR A DRILLING ASSEMBLY

[75] Inventor: Benoit Amaudric du Chaffaut, Versailles, France

[73] Assignee: Institut Francais du Petrole, Rueil Malmaison, France

[21] Appl. No.: 288,086

[22] Filed: Dec. 22, 1988

[30] Foreign Application Priority Data

Dec. 23, 1987 [FR] France ..... 87 18088

[51] Int. Cl.[5] ..... E21B 17/10

[52] U.S. Cl. ..... 175/325; 175/83; 166/237

[58] Field of Search ..... 175/325, 76, 83; 166/237; 192/67 A, 48.5

[56] References Cited

U.S. PATENT DOCUMENTS

| | | | |
|---|---|---|---|
| 1,937,234 | 11/1933 | Lansing | 192/48.5 |
| 2,072,320 | 3/1937 | Thomas | 175/325 |
| 3,370,657 | 2/1968 | Antle | 175/25 |
| 3,656,565 | 4/1972 | Fox | 175/325 |
| 3,746,137 | 7/1973 | Ruschke, Jr. | 192/48.5 |
| 3,909,151 | 9/1975 | Regenbrecht | 408/140 |
| 4,209,070 | 6/1980 | Sudnishnikov et al. | 175/99 |
| 4,606,417 | 8/1986 | Webb et al. | 175/325 |
| 4,733,577 | 3/1988 | Griesser et al. | 192/48.2 |
| 4,807,732 | 2/1989 | Lehle | 192/48.5 |

FOREIGN PATENT DOCUMENTS

| | | | |
|---|---|---|---|
| 1028829 | 7/1983 | U.S.S.R. | 175/325 |

*Primary Examiner*—Ramon S. Britts
*Assistant Examiner*—Terry Lee Melius
*Attorney, Agent, or Firm*—Antonelli, Terry, Stout & Kraus

[57] ABSTRACT

A centering device for an assembly, particularly for drilling, having at least one centering device relative to which the assembly rotates. A driving arrangement is provided for rotationally driving the centering device, with the driving arrangement including a friction clutch in the form of, for example, a disk clutch, cone clutch, or drum clutch.

15 Claims, 6 Drawing Sheets

CENTERING DEVICE THAT CAN BE ENGAGED OR DISENGAGED, SPECIFICALLY FOR A DRILLING ASSEMBLY

BACKGROUND OF THE INVENTION

The present invention relates to a centering device usable in particular for centering in a well a drilling assembly composed of a drill bit and drill collars above same.

The problem of centering drilling assemblies has thus far been solved by placing in the bottom assembly a number of "stabilizers" or centering devices with straight or helical blades which effectively ensure centering of the drill pipes to some extent but at the cost of permanent friction against the borehole wall, since they are rotationally integral with the assembly. In soft rock, this friction results in a widening of the borehole at the level of the stabilizers, and this widening eventually destroys the desired centering function. Once a stabilizer has dug out an accommodation, there is now nothing to prevent the pipes from rubbing against the wall which has not yet been widened.

In vertical drilling, the widening may not be very substantial: the transverse force applied to the pipes is zero in theory, if one overlooks the force of buckling of the drill collars as well as the dynamic effects due to misalignment, slight though it may be. In general, there is no preferred direction for these potential lateral forces and they may be considered to cancel each other out overall, as far as their effect on deflection goes.

In deflected wells, the widening can no longer be overlooked since the rock supports part of the weight of the assembly and even all of the weight in a horizontal well. As a result, the borehole gradually becomes oval in shape and tends to deviate, generally to the right in view of the usual rotational direction of the string of drill pipes due to the reaction to the rolling of the assembly on the wall and wear of the pipes, which may be fairly rapid in abrasive rock.

In the case of sufficiently sharp curvature, the body of the pipe reams out its own accommodation which the larger-diameter equipment located below (stabilizers, tool, etc.) will not be able to pass when raised to the surface again. This is the phenomenon known as "key-seating" which also occurs in the upper part of the assembly where it is the tool joints which become jammed.

It may be seen from this description of phenomena familiar to drillers that the friction of the pipe string on the borehole walls is difficult to control and is often the source of costly problems. It consumes a substantial part of the mechanical power transmitted to the pipe string by the turntable (on the order of 75% at 2000 meters in a borehole with a 12¼" or 31 cm diameter inclined 20° to the vertical), making it extremely difficult to maintain the desired trajectory.

The contradictory solutions supplied to this problem by drilling equipment designers are a reflection of the difficulties encountered for example, it is recommended that the number of stabilizers be increased or also recommended that reamers be employed with the idea of rapidly eroding the borehole walls to reach a certain "profile of equilibrium" more rapidly. Additionally, the stabilizer blades are polished in order not to over-widen the borehole and to reduce the torque loss.

One original solution is to have the stabilizer not rotate with the pipes. The blades are generally rubber shoes attached to a jacket of the same material, in which the assembly may rotate freely. Lubrication is provided by the mud (and debris). Lengthwise translation of the jacket along the body is possible between two annular stops, the lower stop being provided with teeth designed to block rotation if need be (in the event of overdrilling or jamming when the equipment is raised). It seems however that the use of these tools is not very widespread, probably because of their short service lives.

The same principle is used for certain key-seat reamers where the jacket is made of metal and fitted with tough blades, usually helical. The upper stop is then provided with a cam allowing lengthwise hammering.

In, for example, U.S. Pat. No. 2,815,930 a key-seat reamer is made rotationally integral with the pipe string when axial displacement occurs between the blades of the reamer and the pipe string due to an obstruction. This drive is provided by mutual meshing of teeth rotationally integral with the reamer blades and teeth rotationally integral with the pipe string.

Such a device ensures that rotation comes to a complete stop before the teeth are engaged, failing which it would be exposed to severe mechanical stresses which are always detrimental.

The present invention proposes a centering device which does not in general rotate with the pipes, hence ensures effective centering, and yet provides for the possibility of reaming by driving blades rotationally but limiting this possibility to occasions when it is truly necessary, i.e. when the drilling assembly has become jammed in the lengthwise direction. The device according to the invention avoids the drawbacks mentioned above.

Thus, the present invention relates to a device having at least one centering device relative to which said assembly can rotate about its axis. This device is characterized in particular by having means for driving said device rotationally, said means comprising a friction clutch.

This clutch can in particular be a disk clutch, a cone clutch, or a drum clutch.

This clutch may have several disks or cones, some of which will be rotationally integral with said centering device and others with said assembly, these disks or cones overlapping each other.

The device according to the invention may comprise elastic means for positioning the various disks relative to each other.

The device according to the invention may comprise jaw clutch means.

Likewise, the device according to the invention may comprise means for controlling other means for gradual initiation of rotation, said control means being activated above a certain value, the threshold of the difference between the axial stress to which said assembly is subjected and the stress to which said device is subjected.

These control means may comprise return means such as springs.

The control means of said drive means may be assisted by a pressurized fluid.

These control means may be hydraulic and mechanical means combined.

The above and other objects, features and advantages of the present invention will become more apparent from the following description when taken in connection with the accompanying drawings which show, for the purposes of illustration only, several embodiments in accordance with the present invention.

DETAILED DESCRIPTION

Figure 1:
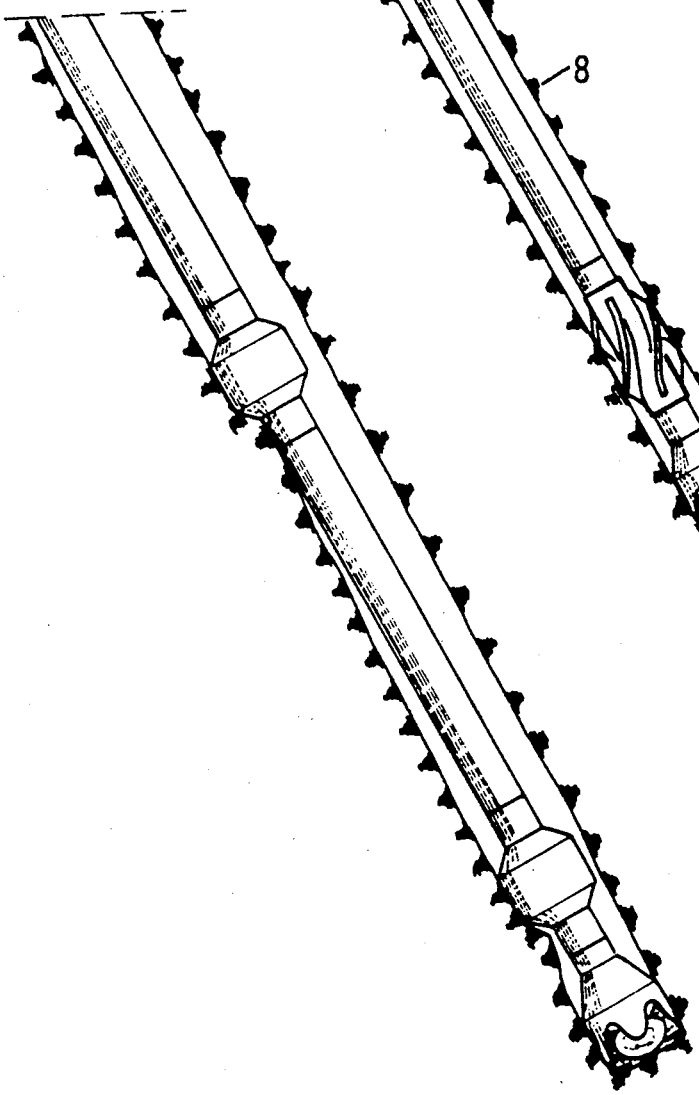
FIG. 1 is a schematic view illustrating problems of centering devices rotationally integral with a pipe string.
Figure 2:
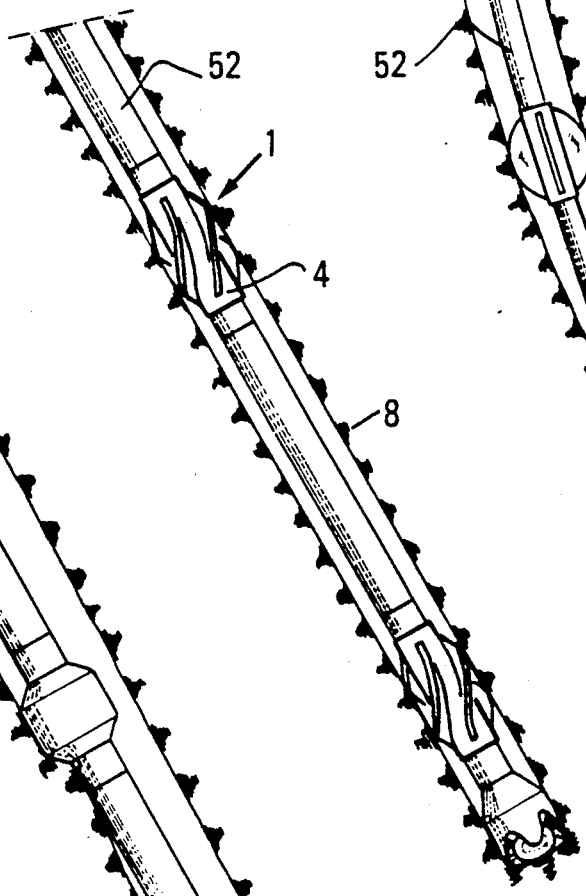
FIG. 2 is a schematic view of one example of a use of centering devices according to the present invention wherein the pipes are driven rotationally from the surface.
Figure 4:
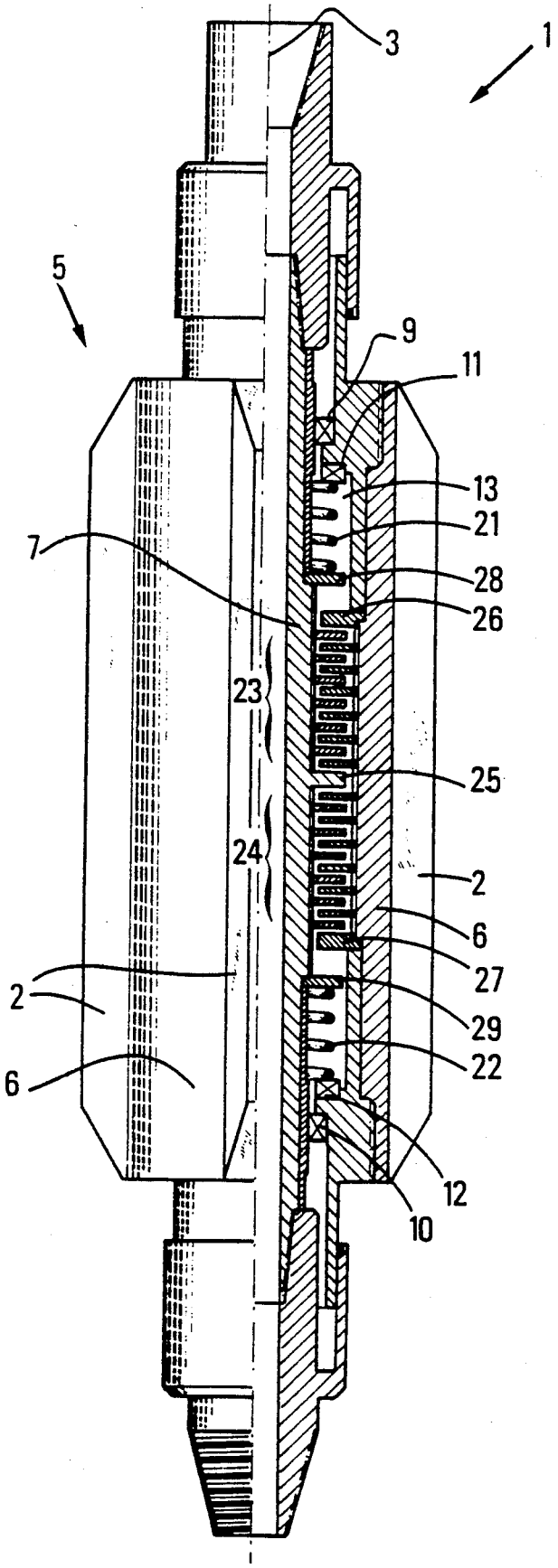
FIG. 4 is a longitudinal partial cross-sectional view of one embodiment of a centering device in accordance with the present invention having two clutch systems.

Referring now to the drawings wherein like reference numerals are used throughout the various views to designate like parts and, more particularly, to FIG. 4, according to this figure, a centering device generally designated by the reference numeral 1 is provided with a plurality of straight blades 2 disposed parallel to the pipe axis or, as shown in FIG. 2, helical blades 4, similar to those with which conventional stabilizers are equipped, and which fit within a volume of revolution having a maximum diameter equal to or slightly less than a diameter of the bore hole. Ends generally designated by reference numeral 5 of the blades 2 are shaped in the form of skids, or beveled, so as to facilitate a longitudinal sliding along walls of the well or bore hole, with the blades 2 being mounted on a cylindrical jacket 6 inside which the tubular body 7 of the device can freely rotate, at least as long as the longitudinal friction of the blades 2 against the walls 8 (FIG. 2) of the borehole remains limited.

Rotation of tubular body 7 in jacket 6 which carries the blades or centering devices is facilitated by the presence of bearings 9, 10 and stops 11, 12 with rollers, rolls, needles, or balls, lubricated by a suitable fluid (oil or grease) contained in fluid-tight fashion in space 13 between jacket 6 and body 7. These bearings 9, 10 and stops 11, 12 are designed to permit translation of the jacket 6 along the body 7 without preventing rotation.

A device for balancing the pressures of the lubricant and the drilling fluid outside the jacket 6 effects the tightness by limiting pressure deviations in the seals and permitting variations in lubricant volume with temperature. Such a device may be of the diaphragm or piston type generally designated by the reference numeral 14. (FIG. 10 and include a piston 15 slidable in a cylinder 16, with a travel of the piston 15 being limited by two stops 17 and 18. One face 19 of piston 15 is in contact with the drilling fluid, the other face 20 is in contact with the lubricating fluid.

This pressure-balancing device may be modified by inserting, between the piston 15 and the stop 18, a helical compression spring which will allow a slight overpressure to be maintained between the lubricant and the mud outside, in order to protect the seals against any inward seepage of mud.

The rotational drive of the blades 2 commences as soon as their longitudinal friction against the borehole walls, in one direction or the other, causes, by relative axial displacement of tubular body 7 in jacket 6, sufficient compression of one of the two return springs 21 or 22 (FIG. 4). Because of the apporach of the clutch stop 25 integral with the tubular body 7 to the clutch stop 26 or 27 which are respectively integral with jacket 6, the associated series of braking disks 23 and 24 respectively is then compressed, progressively causing blades 2 to rotate. Initially, when the blades 2 turn, the clutch disks will slip. If, during this phase, the blades 2 have cleared the obstruction which caused the lengthwise friction, the latter ceases and the system resumes its equilibrium position because of the action of return springs 21 and 22.

If the obstruction persists and presents a strong resistance to the advance of the centering device, despite the entrainment of blades 2, the disks are pressed closer together so that a greater torque is transmitted through the disks. To ensure transmission of a torque greater than that permitted by the disks, it is possible to provide jaws, as shown in the embodiment in FIG. 5.

As shown in FIG. 4, supporting stops 28, 29 or more simply the suports of springs 21 and 22 are integral with tubular body 7 with the springs 21, 22 serving to keep the cylindrical jacket 6 in a central position in which the disks are not stressed.

The other supports are integral with cylindrical jacket 6. In FIG. 4, the supports abut rotating supporting stops 1 and 12, respectively. To enhance the gradualness of transmission of the torque by the disks, a lubricating fluid may be employed.

FIG. 4 provides an example of a centering device equipped with jaws and, according to this figure, an upper part of the centering device is provided with two sets of jaws 30, 31 adapted to cooperate with each other to form a first pair of jaws, with two other sets of jaws 32, 33 being provided and being adapted to cooperate with each other to form a second pair of jaws. For each of these pairs of jaws there is a set of jaws, i.e., sets 30 and 32, respectively, which is integral with a supporting stop, i.e., supports 28 and 29, respectively, which itself is rotationally integral with the tubular body 7. Each of the other sets of jaws 31, 32, respectively, of each pair of jaws is integral with one of the supporting stops, i.e., stops 34 and 35, respectively, itself rotationally integral with the cylindrical jacket 6.

In order for the jaws to engage after the clutch disks have come into intimate contact, the stops with jaws which are rotationally integral with jacket 6 can move in the direction of the axis of the jacket.

This can be accomplished by a system of grooves. Return springs 26 and 37 control the pressure exerted on the clutch disks and permit the jaws to engage only when a preset pressure is exceeded.

It is apparent that the distance separating the two jaws of one pair (30, 31 or 32, 33) is greater than the sum of the gaps separating the various disks in a series of disks 23 and 24, respectively.

Figure 6:
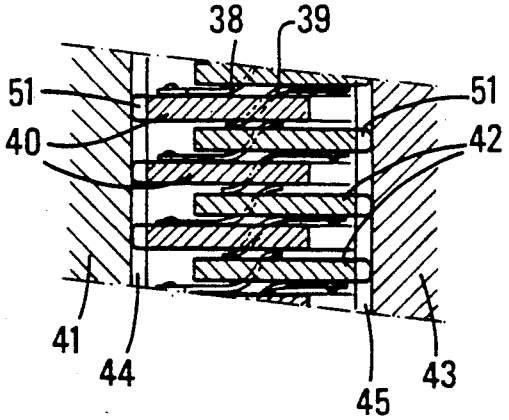
FIG. 6 is a partial longitudinal cross-sectional view of a portion of the various clutch disks to be positioned.

In order for the disks not to rub against each other in the absence of axial stress on the blades, the various disks may be kept apart by leaf springs such as those represented in FIG. 6 and referenced 38 and 39.

Leaf springs 38 separate disks 40 which are rotationally integral with tubular body 41, and leaf springs 39 separate disks 42 which are rotationally integral with jacket 43. The disks 40, 42 are respectively rotationally integral with the tubular body 41 and jacket 43 by grooves 44, 45, respectively.

Figure 5:
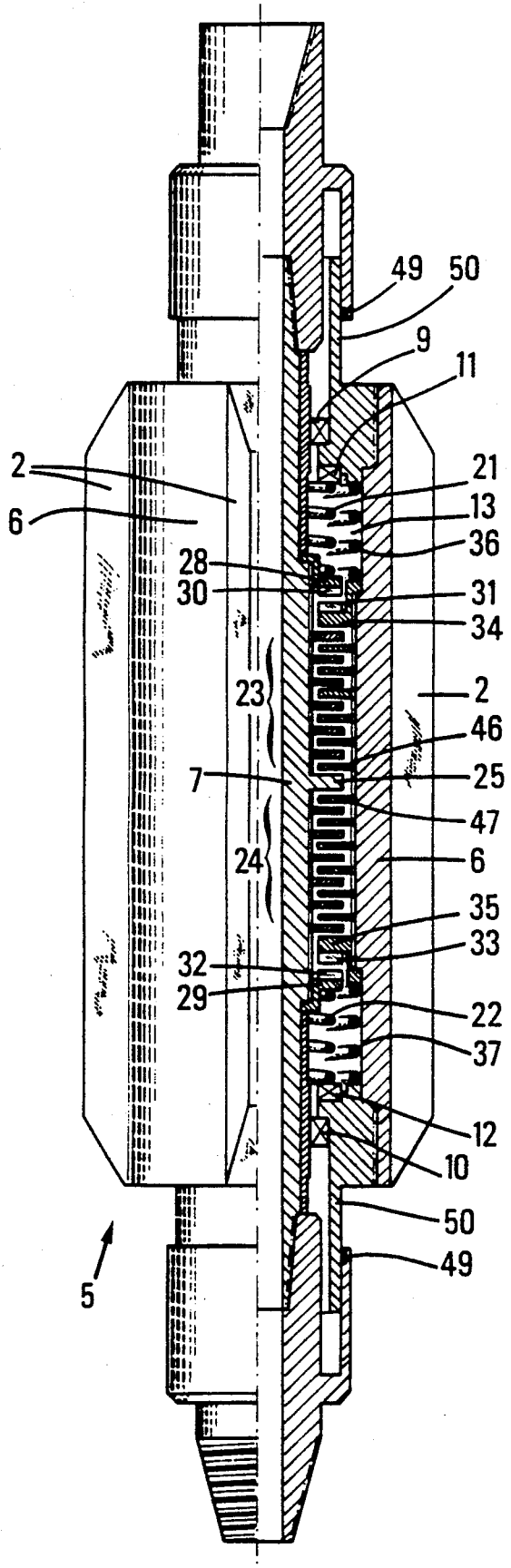
FIG. 5 is a longitudinal partial cross-sectional view of a centering device constructed in accordance with the present invention having two clutch system and two jaw systems.

Of course, the set of disks rotationally integral with the tubular body and the set rotationally integral with the jacket and interlocking with each other, can be kept apart by means of leaf springs 38 and 39 as well as additional leaf springs which allow a reference position to be obtained. In FIG. 5, these additional leaf springs may be placed (1) between central stop 25 and the disks nearest this stop which are rotationally integral with tubular body 7, and (2) between stops 28 and 29 and the disks rotationally integral with tubular body 7 which are, respectively, nearest to each of the stops. The end disks rotationally integral with the jacket can be positioned by leaf springs placed between these disks and stops 34 and 35 respectively integral with the jacket. In the center, in the vicinity of the central stop, disks 46 and 47 rotationally integral with jacket 6 can be held by leaf springs attached to jacket 6 itself.

The sealed space 13 can be delimited by seals 49 fixed with respect to the tubular body which cooperate with cylindrical seats 50 integral with the jacket. Of course, the size of the seats is sufficient to allow the jacket to effect extreme travel without thereby interrupting the sealing function.

The brake disks have the role of synchronizing the respective rotational speeds of the body, which can rotate for example at 150 rpm, and the blades 2, which are normally motionless, before the engagement of jaws 30, 31 or 32, 33. The disks are movable in axial translation and rotationally integrated with the body or the jacket by means of pins 51 which engage grooves 45 provided for the purpose (see FIG. 6). This function can be carried out by any other appropriate device, friction cones for example, provided however that transmission of the rotational torque to the blades is sufficiently gradual and that it causes no excessive wear or heating. The goal in view is to drive the blades when needed with sufficiently slow rotation to disengage the centering device with a minimum of erosion of the borehole wall. In the FIG. 5, synchronization and engagement of the jaws constitutes a mechanical clutch.

Figure 7:
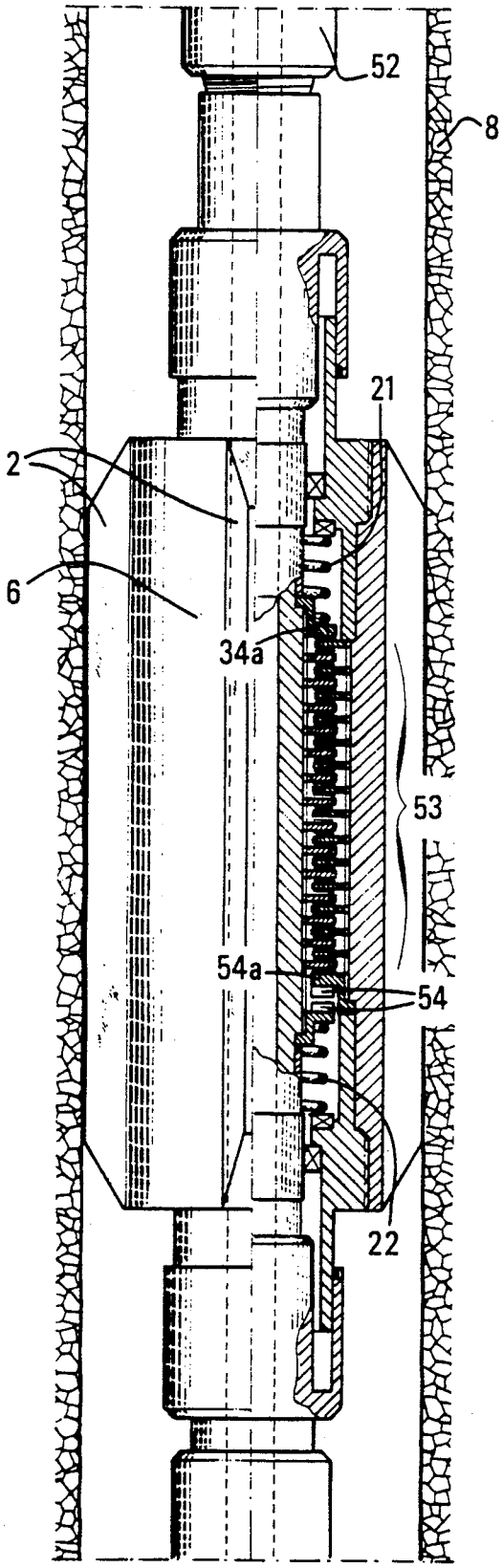
FIGS. 7–9 are longitudinal partial cross-sectional views of another embodiment of a centering device constructed in accordance with the present invention.

In FIG. 7 a device is provided which has a set of clutch disks 53 and a jaw system or pair of jaws 54, with the device being constructed is designed such that, when stops 54*a* and 34*a* press disks 53 against each other, causing jacket 6 to rotate, the two sets of jaws of jaw systems 54 move apart from each other and conversely, when the two sets of jaws approach one another, disks 53 are no longer pressed against each other.

Figure 8:
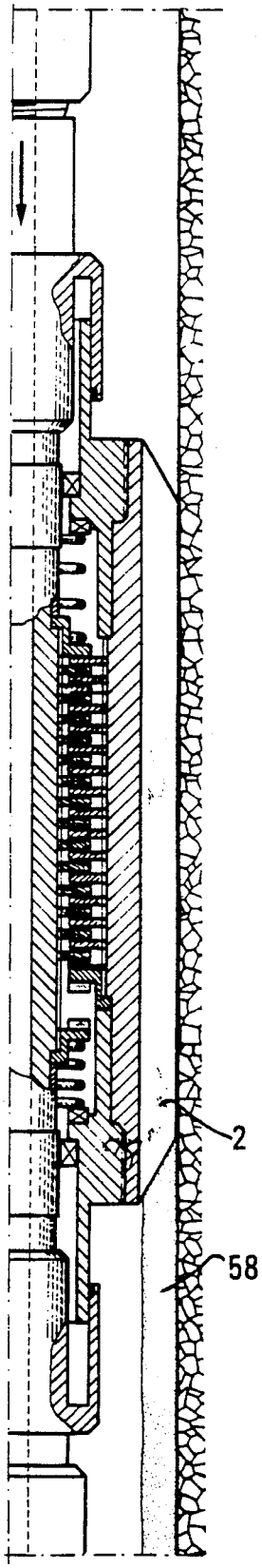

Rotational clutch engagement occurs, for example, when assembly 52 is being raised, in the case of jamming while pulling because of fallen rock 56 above the centering device (as in FIG. 9), or when the assembly is being lowered, if hole 57 has shrunk, for example because of substantial filtration deposits 58 or during drilling if blades 2 penetrate deeply into over-soft walls (as in FIG. 8). The centering device then temporarily becomes a reamer and disengages rapidly by rotation to resume its original function (see FIGS. 4, 5, 7, or 10).

In normal operation (drilling), jacket 6 bearing blades 2 is kept in the median position by two return springs 21 and 22 with sufficient clearance in each of the two directions to prevent untimely engagement of rotation by possible axial vibrations of the assembly. The stiffness of the springs should be adapted to the composition of the string of pipes. In particular, it will be important to prevent the set of centering devices employed from being able to support too great a share of the weight on the tool without starting to rotate, which would occur with overly stiff springs. Conversely, overly soft springs would mean permanent reaming and centering would rapidly become ineffective.

The total system is dimensioned to withstand the axial and lateral stresses and impacts normally encountered by the drilling assembly at the point of insertion.

The drill body may have the same mechanical characteristics as the pipes or drill collars between which it is placed. Its inside diameter, if it must be different from that of the neighboring pipes, will not create an excessive pressure loss in the drilling fluid flow. The connection with the neighboring pipes may be provided by suitable threads and seals.

Figure 10:
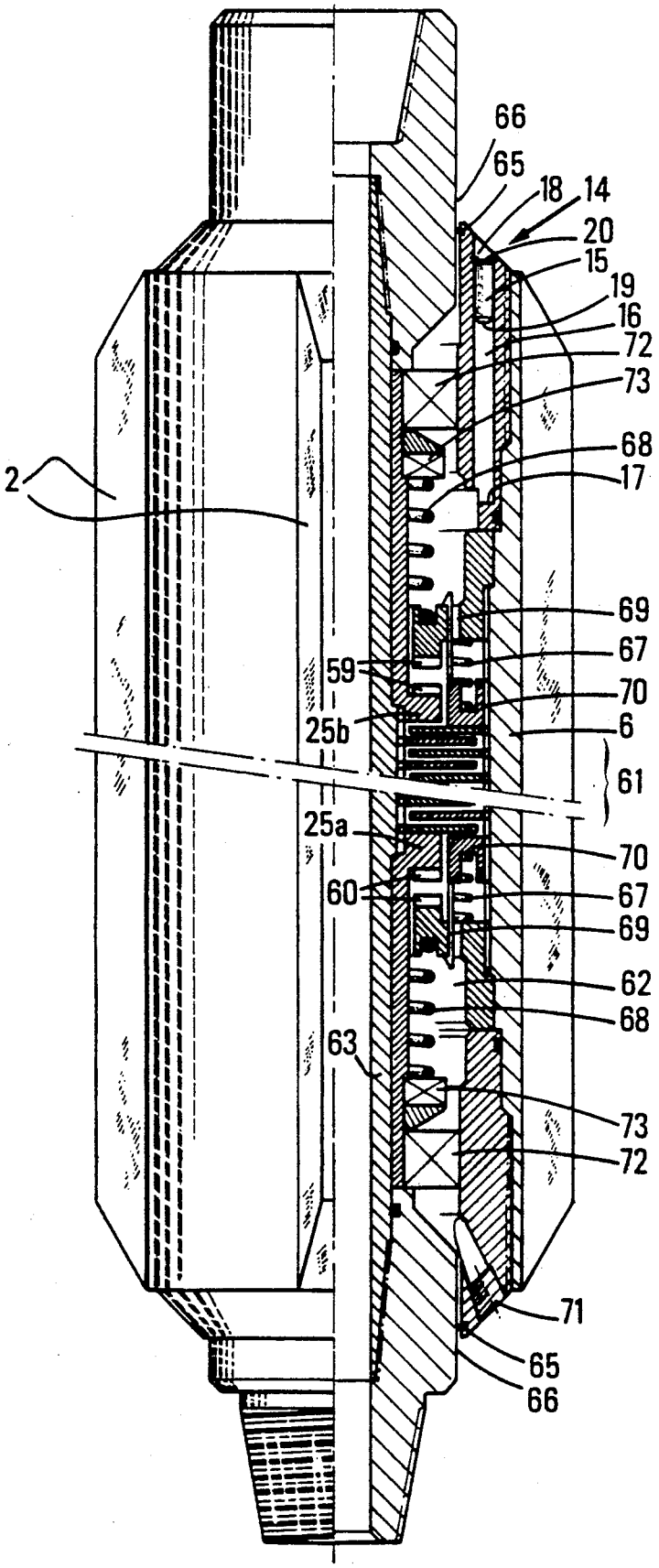
FIG. 10 is a longitudinal partial cross-sectional view of a further embodiment of the present invention having a double acting clutch.

FIG. 10 represents a particularly useful embodiment according to which there are two pairs of jaws 59 and 60 designed respectively for the two axial friction directions of the centering device in the well. According to this embodiment, it is only necessary for a single set of clutch disks to be stressed in the two axial friction directions of the centering device in the well or bore hole.

This essentially results from elimination of central stop 25 (FIG. 5), which can be replaced by a clutch disk rotationally integral with tubular body 7 and by the transfer of the functions of this stop on either side of the clutch disks to stops 25*a* and 25*b* (FIG. 10) rotationally integral with tubular body 63, the arrangement of the pairs of jaws then being reversed.

Of course, the embodiment in FIG. 10 does not admit of clutches of different characteristics depending on the direction of axial friction, while this is permissible in the embodiment shown in FIG. 5.

Moreover, in the embodiment in FIG. 10, the tightness of space 62 delimited by the outer wall of tubular body 63 and jacket 6 is provided by seals 65 which cooperate directly with a seat 66 composed of the outer surface of a cylinder integral with the tubular body, while in the embodiment in FIG. 5 seal 49 cooperates with the outer surface of a cylinder integral with jacket 6.

Springs 67 control the pressure compressing the disks while springs 68 position the jacket relative to the tubular body in the absence of axial friction force.

Hooks 69 are provided for limiting the travel of the stops 70, rotationally integral with the jacket 6. Plug 71 allows a space 62 to be emptied or filled with a fluid to lubricate the bearings 72, 73 and disks 61.

The centering device described in the above embodiments, which can be engaged or disengaged, effects progressive rotational drive of the blades, triggered only by lengthwise friction of the system against the borehole wall. Since this friction is poorly defined, it is possible, under specific operating conditions, for the device to remain for non-negligible periods in an intermediate position in which the clutch is not engaged, but in which the frictional surfaces are already undergoing heat-and-wear-generating friction which may be detrimental in the long run.

It accordingly seems important to minimize the duration of this intermediate position in order to guarantee correct operation of the system for a sufficiently long time.

Figure 11:
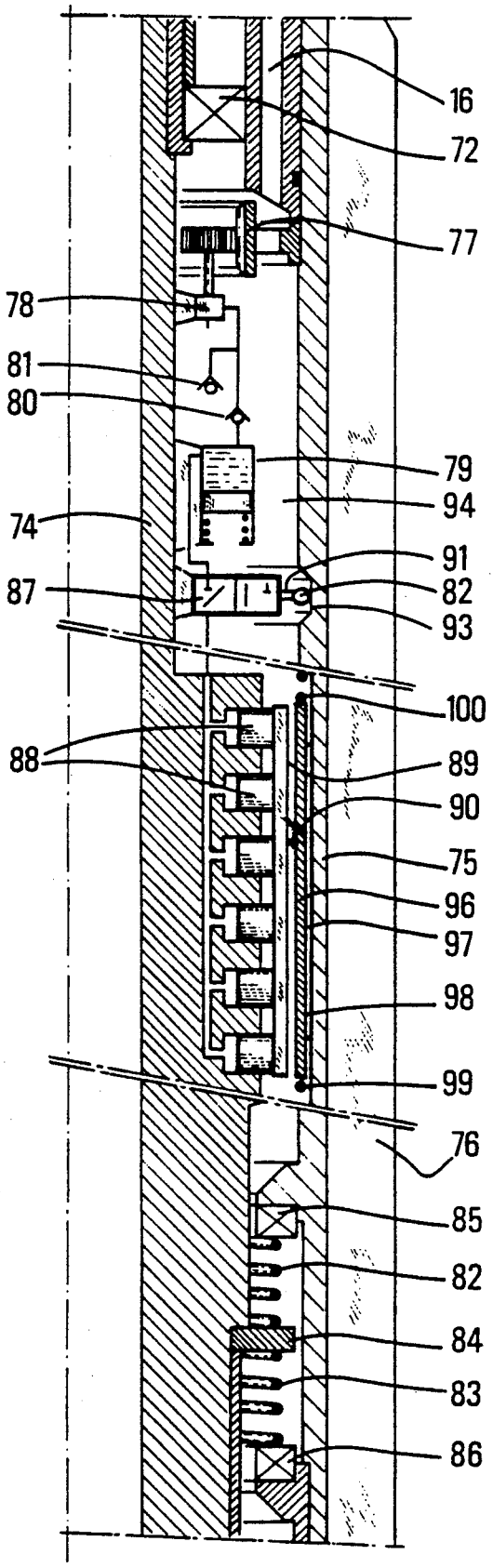
FIG. 11 is a longitudinal partial cross-sectional view of a further embodiment of the present invention wherein a clutch control system has a pressurized fluid.

This may be accomplished for example by replacing the purely mechanical clutch control by combined hydraulic and mechanical control as described in FIG. 11.

In FIG. 11, rotation of body 74 in jacket 75 bearing blades 76 is used to activate, through a gear transmission 77, a small oil pump 78 integral with tubular body 74. This pump fills a high-pressure, variable-volume chamber 79 with oil. The pressure in this chamber is kept at a preset value by a check valve 80 and by a calibrated valve 81 which diverts the pump flow once the selected pressure is attained.

Lengthwise displacement of jacket 75 with respect to body 74 is still controlled by return springs 82 and 83 which cooperate with axial stops 84, 85, and 86, some of which can be rotating as in the case of stops 85 and 86.

In this embodiment, the frictional surfaces constituting the clutch are unable to approach one another before a preset threshold lengthwise displacement value has been reached. This threshold value is fixed by the geometric characteristics of a hydraulic flip-flop, off-on system, or slide valve 87 which, once the displacement threshold has been reached, suddenly places high-pressure chamber 79 in communication with a set of jacks 88 pressing clutch surfaces 89 and 90 together. In the case of FIG. 11, this is a drum clutch.

Clutch surface 90 is rotationally integral with jacket 75 but movable in axial translation. This is achieved by the use of a sleeve 96 having ribs 97 which cooperate with grooves 98 provided in jacket 75. Springs 99 and 100 allow sleeve 96 to be held in an intermediate position in the absence of clutching.

Slide valve 87 is controlled by an arm 91 having a wheel 92 which cooperates with a groove 93. Axial displacement of jacket 75 relative to body 74 out of the equilibrium position shown in FIG. 11 causes arm 91 to retract into slide valve 87 and causes activation of jacks 88.

The duration of the slipping of clutch 89, 90 is thus reduced to a minimum which depends only on the filling time of jacks 88. The contact pressure of clutch surfaces 89 and 90 is fixed and depends only on the calibration of valve 80.

When the lengthwise friction of blades 76 which caused clutch engagement has ceased, return springs 82 and 83 bring jacket 75 back to its central position as shown in FIG. 11, slide valve 87 vents clutch jacks 88 to annular space 94, thus allowing the clutch to disengage, and re-seals high-pressure chamber 79 which can then be recharged by the rotation of the body in the jacket for a new sequence. The fluid is fed to the pump 78 from the annular space 94.

It will not be a departure from the present invention to reverse the layout of transmission 77, pump 78, high-pressure chamber 79, slide 87, groove 93, jacks 88, and contact surfaces 89 and 90 of the clutch between body 74 and jacket 75.

Figure 9:
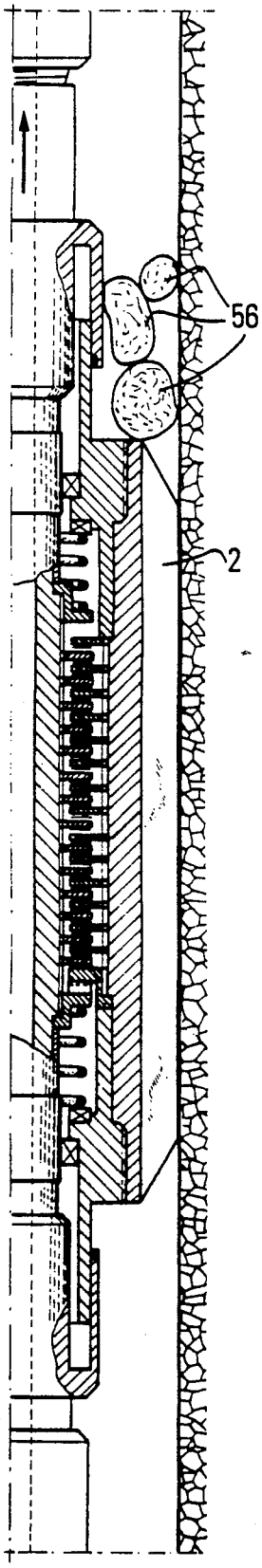
Figure 12:
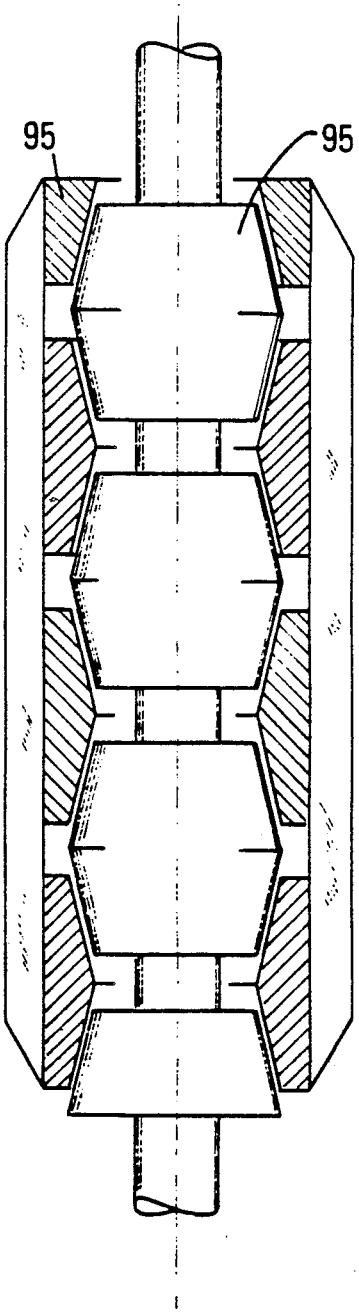
FIG. 12 is a schematic partial cross-sectional view of a centering device constructed in accordance with the present invention utilizing clutch cones.

FIG. 12 provides an example of a centering device in accordance with the present invention utilizing a cone clutch 95; however, the operation of the embodiment of FIG. 9 is the same as that of the disk clutches described hereinabove.

The centering device proposed in the present invention may be considered a rotational bearing "self-carried" by assembly 52; its role is to cancel the tangential component of the reactions resulting from contact between the pipes and the wall of the borehole, whatever the rotational speed of the assembly, which considerably cuts down on torque losses and violent transverse oscillations. To the extent that lengthwise friction remains limited, it is likely that the arrangement of some of the centering devices, just above the drill bit and in the final lengths of the assembly, will produce smooth and thus more efficient drilling, a better calibrated borehole, and a more regular drilling path than with classic stabilizers. If the lengthwise friction is substantial, for example in overly soft rock where the blades penetrate deeply into the walls, or if the walls become thickly caked due to filtration of mud into the rock, the rotational clutching of the centering device will gradually bring the assembly and the centering device back into the classical reaming configuration. In general, it will be preferable for the blades to spiral to the right in order for the force against the wall to be distributed over a greater part of the circumference and so that when rotation of the blades begins during drilling, it will cause them to advance by a slow screwing action before they start to erode the wall.

Figure 3:
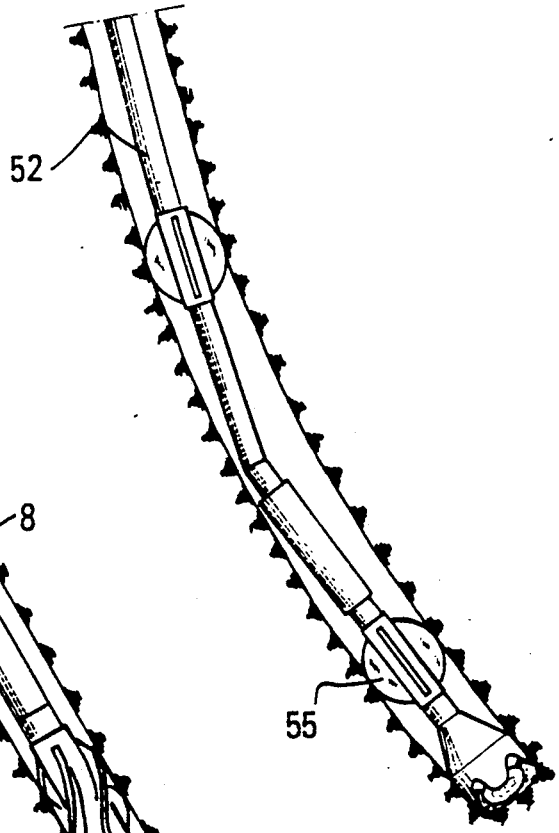
FIG. 3 is a schematic view of another example of a use of centering devices according to the present invention wherein a bottom assembly has a bent connector and a bottom motor, and wherein only pipes located under the bottom motor are driven rotationally as in the case of deflected bore holes.

If the drilling path must be curved as shown in FIG. 3, the profile of the blades will preferably be such that they are inscribed in a sphere or an ovoid such that the angular gap between the well axis and the pipe axis, created for example by a bent connector, is formed with no parastic bending moment. This is the case for blades 55 shown in FIG. 3.

For a straight-line drilling path, on the other hand, the blades will be inscribed in a relatively long cylinder, providing a tight fit which will limit flexion, as is the case for helical blades 4 in FIG. 2. The centering device thus fits naturally into the bottom assembly used for slanted boreholes where it is necessary to create temporary contact points for the drill collars against the wall to maintain or modify the path, without these contacts causing excessive torque losses or repeated impacts which, with classic stabilizers, result in uncontrollable widening and deflections, slow advance, and abnormal equipment wear. In vertical boreholes, it will limit the rotational power losses and undesirable deflections by bringing about true stabilization of the bottom assembly.

On the other hand, if the formations traversed are appropriate (hard rock), the use of a large number of these centering devices should allow a far longer length of assembly to be compressed than that normally used to apply weight to the tool.

The drill collars would then be lighter but more numerous, and in the extreme case would be replaced altogether by pipes alone. The usefulness of this arrangement is to limit the weight of the pipe string and hence save on lifting power and reduce the well-bottom diameters; among other advantages, this would allow greater maneuvering speed for swabbing.

Finally, the reduction of torque losses and impacts in the assembly would allow the new cutting tools generally known as P.D.C. (Polycrystalline Diamond Cutters) to be used; these require more torque for a given weight than the classical tricones, but their applications are currently limited by their low impact resistance. The centering devices may also be employed in the upper parts (stressed by pulling) of a drilling assembly to limit the friction of the rods against the walls, which is particularly important in curved parts of the well (build-up) to avoid the formation of key-seats, and in cased parts, sensitive to abrasion of tool joints.

I claim:

1. A centering device, for centering a drilling assembly, comprising at least one centering element relative to which said drilling assembly can rotate, and means for rotationally driving said at least one centering element including a friction clutch means interposed between said at least one centering element and said drilling assembly, wherein said friction clutch means is one of a disk clutch means, cone clutch means or drum clutch means.

2. A centering device, for centering a drilling assembly, comprising at least one centering element relative to which said drilling assembly can rotate, and means for rotationally driving said at least one centering element including a friction clutch means interposed between said at least one centering element and said drilling assembly wherein said friction clutch means is one of a disk clutch means or a cone clutch means respectively having a plurality of clutch disks or clutch cones, some of which are rotationally integral with said at least one centering element and others of which are rotationally integral with said drilling assembly, and wherein said clutch disks or clutch cones are disposed in an overlapping relationship with respect to each other.

3. A centering device according to claim 2, wherein elastic means are provided for positioning the various clutch disks relative to each other.

4. A centering device according to one of claims 1, 2 or 3, further comprising means for controlling said means for rotationally driving, said means for controlling being adapted to be activated beyond a certain threshold value of a difference between an axial stress to which said drilling assembly is subjected and that to which said at least one centering element is subjected.

5. A centering device according to claim 4, wherein said means for controlling includes elastic return means.

6. A centering device according to claim 2, wherein said clutch disks are immersed in a lubricating fluid for facilitating a gradual engagement of said clutch disks.

7. A centering device, for centering a drilling assembly, comprising at least one centering element relative to which said drilling assembly can rotate, and means for rotationally driving said at least one centering element including a friction clutch means interposed between said at least one centering element and said drilling assembly and jaw clutch means for transmitting rotational movement between the at least one centering element and the drilling assembly upon engagement of the friction clutch means.

8. A centering device for centering a drilling assembly, comprising at least one centering element relative to which said drilling assembly can rotate, means for rotationally driving said at least one centering element including a friction clutch means interposed between said at least one centering element and said drilling assembly, bearing means for rotatably supporting the at least one centering element for rotational movement relative to the drilling assembly, and stop means for defining displacement positions of the at least one centering element relative to the drilling assembly, and wherein said bearing means and said stop means includes at least one of rollers, rolls, needles, or balls.

9. A centering device for centering a drilling assembly, comprising at least one centering element relative to which said drilling assembly can rotate, and means for rotationally driving said at least one centering element including a friction clutch means interposed between said at least one centering element and said drilling assembly, and wherein bearing means are provided for rotatably supporting the at least one centering element for rotational movement relative to the drilling assembly, and stop means are provided for defining the displacement positions of the at least one centering element relative to the drilling assembly, said bearing means and said stop means includes at least one of rollers, rolls, needles or balls, and said bearing means and stop means are lubricated by a fluid contained in a fluid-tight manner between said at least one centering element and said drilling assembly.

10. A centering device for centering a drilling assembly, comprising at least one centering element relative to which said drilling assembly can rotate, and means for rotationally driving said at least one centering element including a friction clutch means interposed between said at least one centering element and said drilling assembly, and wherein a combined hydraulic and mechanical means is provided for controlling said means for rotationally driving.

11. A centering device according to claim 10, wherein said combined hydraulic and mechanical means comprises a hydraulic pump means for supplying a hydraulic fluid, a gear transmission means for transmitting rotational motion between the at least one centering element and the drilling assembly, a high-pressure chamber means for receiving the hydraulic fluid from the hydraulic pump means, a slide valve means for controlling a flow of the hydraulic fluid from the high-pressure chamber means to the friction clutch means and thereby controlling an operation of the friction clutch means, and jack means in communication with the slide valve means and operable by the hydraulic fluid for causing an engagement of the friction clutch means.

12. A centering device according to one of claims 7 or 10, wherein said friction clutch means is one of a disc clutch means, cone clutch means or drum clutch means.

13. A centering device according to one of claims 7 or 10, wherein said friction clutch means is one of a disc clutch means or a cone clutch means respectively having a plurality of clutch discs or clutch cones, some of which are rotationally integral with said at least one centering element and others of which are rotationally integral with said drilling assembly, and wherein said clutch discs or clutch cones are disposed in an overlapping relationship with respect to each other.

14. A centering device according to claim 13, wherein elastic means are provided for positioning the various clutch discs relative to each other.

15. A centering device for centering a drilling assembly, comprising at least one centering element relative to which said drilling assembly can rotate, and means for rotationally driving said at least one centering element including a friction clutch means interposed between said at least one centering element and said drilling assembly, means for controlling said means for rotationally driving, said means for controlling being adapted to be activated beyond a certain threshold value of a difference between an axial stress to which said drilling assembly is subjected and that to which said at least one centering element is subjected.

* * * * *